US005545945A

United States Patent [19]

Branovich et al.

[11] Patent Number: 5,545,945

[45] Date of Patent: Aug. 13, 1996

[54] THERMIONIC CATHODE

[75] Inventors: Louis E. Branovich, Howell; Donald W. Eckart, Wall; Paul Fischer, Oakhurst, all of N.J.

[73] Assignee: The United States of America as represented by the Secretary of the Army, Washington, D.C.

[21] Appl. No.: 413,041

[22] Filed: Mar. 29, 1995

[51] Int. Cl.[6] ..... H01J 1/14

[52] U.S. Cl. ..... 313/346 R; 313/346 DC

[58] Field of Search ..... 317/346 R, 346 DC, 317/310

[56] References Cited

U.S. PATENT DOCUMENTS 4,783,613 11/1988 Yamamoto et al. .
4,810,926 3/1989 Schwarz et al. ..... 313/346 DC
4,818,480 4/1989 Branovich et al. .
4,840,767 6/1989 Branovich et al. .
4,895,699 1/1990 Branovich et al. .
4,924,137 5/1990 Watanabe et al. .
5,074,818 12/1991 Branovich et al. ..... 313/346 DC
5,114,742 5/1992 Branovich et al. .
5,118,984 6/1992 Saito et al. .
5,126,622 6/1992 Jeong et al. ..... 313/346 DC
5,298,830 3/1994 Branovich et al. ..... 313/346 R

*Primary Examiner*—Nimeshkumar D. Patel
*Attorney, Agent, or Firm*—Michael Zelenka; William H. Anderson; James A. Digiorgio

[57] ABSTRACT

A thermionic cathode having an overcoating of emissive material having a composition including a mixture Aluminum Tungstate and Scandium Tungstate which react, when heated, to provide the cathode with enhanced electron emissions.

9 Claims, 1 Drawing Sheet

THERMIONIC CATHODE

GOVERNMENT INTEREST

The invention described herein may be manufactured, used, and licensed by or for the Government of the United States of America without the payment to us of any royalty thereon.

FIELD OF INVENTION

This invention relates in general to thermionic emitters, and more particularly to thermionic cathodes having an overcoating that enhances the electron emissions of the cathode.

BACKGROUND OF THE INVENTION

Thermionic cathodes are well known in the electronics industry. Presently, there are two basic types of thermionic cathodes: (1) the impregnate-type, and (2) the top-layered type. The difference between the two types of thermionic cathodes is their physical structure.

Generally, impregnant-type thermionic cathodes are composed of a porous billet impregnated with a semiconductor having a predetermined composition of materials that react with the billet material, when heated, to generate electron emissions. Layered-type cathodes, on the other hand, are generally composed of a base material having a surface upon which a layer of emissive material is formed. The base can be an impregnated billet or even a multi-layered material as long as the base and the top layer react, when heated, to emit electrons.

Specific examples of cathodes formed by this general model are described in several U.S. Patents issued to some of the inventors herein. The following is a list of some of these U.S. Patents, all of which are incorporated herein by reference: U.S. Pat. No. 5,114,742, entitled, "Method of Preparing an Improved Scandate Cathode;" U.S. Pat. No. 5,074,818, entitled, "Improved Scandate Cathode;" U.S. Pat. No. 4,895,699, entitled, "Barium Peroxide, Iridium and Excess Tungsten as Impregnants for Cathodes;" U.S. Pat. No. 4,840,767, entitled, "Method of Making a Cathode from Tungsten and Iridium Powders Using a Barium Iridiate Formed from Barium Perioxide and Iridium Oxide as the Impregnant;" U.S. Pat. No. 4,818,480, entitled, "Method of Making Oxyanion using $BaO_2$ with Ir and Os or Rh for Cathode Impregnation;" and U.S. Pat. No. 5,298,830, entitled, "Method Of Preparing An Impregnated Cathode With An Enhanced Thermionic Emission From A Porous Billet And Cathode So Prepared."

Other Patents that illustrate the different compositions: of thermionic cathodes, which are also incorporated herein by reference, include: U.S. Pat. No. 5,118,984, entitled "Electron Tube Cathode," issued Jun. 2, 1992, to Saito et al.; U.S. Pat. No. 4,924,137, entitled "Cathode For Electron Tube," issued May 8, 1990 to Watanabe et al; and U.S. Pat. No. 4,783,613, entitled "Impregnated Cathode," issued Nov. 8, 1988, to Yamamoto et al.

These patents clearly show that the electron emission efficiency of thermionic cathodes directly depends on the chemical mechanism under which the cathode operates. In addition, the Patents show that the chemical mechanism under which the cathode operates depends on the structure and composition of the materials that make up the cathode For example, the Saito '984 patent teaches of and describes a layered-type cathode composed of three discrete layers of material; a base, a metal layer, and an emissive layer. The materials in these layers react, when heated, to generate electron emissions. More specifically, when the Saito cathode is heated a reducing agent migrates from the base to the emissive layer to initiate electron emissions therefrom. Thus, the Saito cathode depends on a Knudson-type flow mechanism, wherein a reducing agent migrates from a material furthest from the emissive surface of the cathode, to generate electrons.

In contrast, the Branovich '830 patent teaches of and describes a thermionic cathode having a completely different structure, and thus a completely different mechanism form generating electrons. Generally, the Branovich cathode utilizes an emissive material composed of at least one oxygen deficient compound and at least one fully oxidized material which react, when heated, to enhance the electron emissions of the cathode. More specifically, the Branovich cathode is structured such that this emissive material is located as close to the emissive surface of the cathode as possible so that when the cathode is heated, the oxygen deficient material reacts with the fully oxidized material to generate electron emission at lower temperatures than, for example, the Saito cathode. Moreover, as electrons are generated the emissive material goes through a chemical reaction which constantly regenerates the oxygen deficient material, and thus provides improved electron emissions over the prior art.

In copending application, U.S. patent application Ser. No. 08/218,533, entitled "Improved Thermionic Cathode and Method of Making The Same," filed Mar. 28, 1994, the applicants of the present invention disclosed that the emission of the cathode, utilizing the Branovich mechanism as described above, depends upon the formation of oxygen deficient compounds and their ratio to the oxygen sufficient or fully oxidized materials. Moreover, it has been shown in all cases that the amount of oxygen sufficient or fully oxidized material must be greater than the amount of oxygen deficient material, and that the optimum ratio is not the same for all combinations of oxygen deficient and fully oxidized material.

In addition, in the above cited co-pending application, the inventors of the present invention disclosed several ways emissions could be maximized, including: (1) Adding an oxygen deficient compound to an impregnant; (2) Adding compounds, such as Aluminum Tungstate, $Al_2(WO_4)_3$, or Scandium Tungstate, $Sc_2(WO_4)_3$, which in the presence of Tungsten, W, react to form oxygen deficient compounds, such as $WO_2$ and $AlWO_4$ or $ScWO_4$; and (3) Adding composites of 1 and 2 above.

Thus, the applicants have disclosed that adding Aluminum Tungstate Or Scandium Tungstate could enhance emissions through the Branovich mechanism. However, it has not been disclosed that a mechanism for enhancing emissions exists for a cathode having a mixture of Aluminum Tungstate and Scandium Tungstate.

SUMMARY OF THE INVENTION

Accordingly, the object of this invention is to provide a thermionic cathode having a composition including Aluminum Tungstate and Scandium Tungstate such that, when operating, a mechanism exists for enhancing the emissions of the cathode. To attain this, the present invention provides a thermionic cathode having a composition including Tungsten (W), Barium (Ba), and a top layer overcoating composed of materials that form a predetermined mixture of Aluminum Tungstate and Scandium Tungstate which react with the W and Ba, when heated, to provide the optimum ratio of oxygen deficient material to fully oxidized material at the emissive surface of the cathode.

In one embodiment of the invention, the cathode is composed of a Tungsten Billet impregnated with a material including Barium, and a top layer overcoating deposited on a predetermined surface of the impregnated billet to form an emissive surface thereon. The top layer overcoating is composed of a predetermined mixture of materials that form, when heated, a predetermined amount of Aluminum Tungstate and Scandium Tungstate having a predetermined ratio to each other such that the ratio of oxygen deficient material to fully oxidized material, and thus the electron emissions of the cathode, is optimized.

In another embodiment of the invention, the cathode is composed of a plurality of layers of material which include Barium and Tungsten, and a top-layer overcoating forming an emissive surface thereon. As in the above embodiment, the top layer is composed of a predetermined mixture of materials that form, when heated, a predetermined amount of Aluminum Tungstate and Scandium Tungstate having a predetermined ratio to each other such that the ratio of oxygen deficient material to fully oxidized material, and thus the electron emissions of the cathode, is optimized.

These and other features of the invention are described in more complete detail in the following description of the preferred embodiment when taken with the drawings. The scope of the invention, however, is limited only by the claims appended hereto.

DETAILED DESCRIPTION OF THE INVENTION

Figure 1:
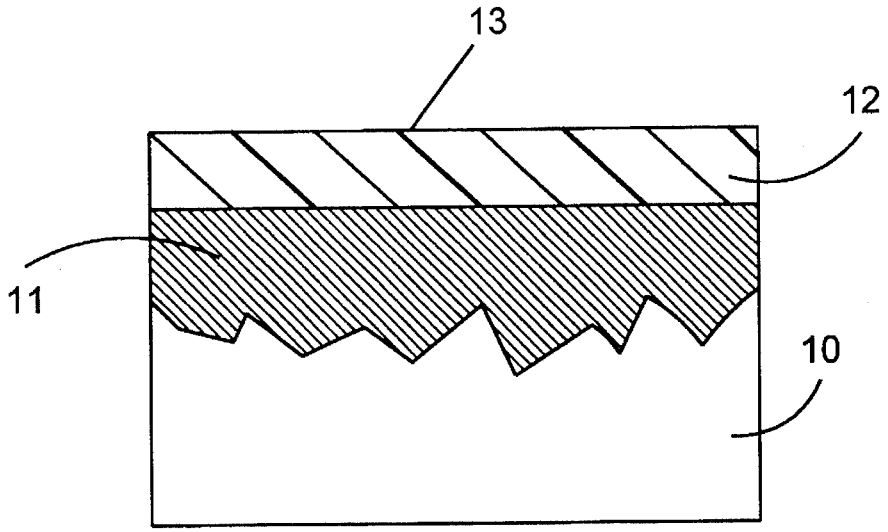
FIG. 1 is a cross-section illustration of one embodiment of the invention wherein an impregnated cathode has a top-layer overcoating forming an emissive surface thereon.

Referring now to the drawings, FIG. 1 shows one embodiment of the invention, an impregnant-type thermionic cathode having a billet 10 impregnated with impregnant 11. As shown, a top layer or overcoat 12 is deposited on a surface of the impregnated billet 10 such that an emissive surface 13 is formed thereon.

Billet 10 can be chosen from the Group VI metals, such as Tungsten. Impregnant 11 can be chosen from the Group II metals, such as Barium. Overcoat 12, however, is a predetermined mixture of Aluminum Tungstate and Scandium Tungstate or any combination of materials that will form the predetermined mixture of Aluminum Tungstate and Scandium Tungstate, when heated. Examples of groups of materials that can form the predetermined mixture include: (1) $AL_2O_3$ and $Sc_2O_3$; and (2) $AlScO_3$ and $WO_3$.

The mixture of Aluminum Tungstate and Scandium Tungstate must be such that when the cathode is in operation a predetermined amount of fully oxidized material and oxygen deficient material are formed wherein the amount of fully oxidized material is greater than the amount of oxygen deficient material so that the electron emissions of the cathode is enhanced.

For example, a thermionic cathode formed from a Tungsten billet, an impregnant including Barium and a top layer of material including $Al_2O_3$, $Sc_2O_3$ and $WO_3$ can provide the proper mixture of Aluminum Tungstate and Scandium Tungstate in the top layering of the cathode, and thus provide enhanced emissions of the cathode when heated. The chemical reactions for this cathode are as follows:

1. $Al_2O_3+3WO_3 \rightarrow Al_2(WO_4)_3$
2. $SC_2O_3+3WO_3 \rightarrow Sc_2(WO_4)_3$
3. $Al_2(WO_4)_3+W \rightarrow 2WO_2+2AlWO_4$
4. $SC_2(WO_4)_3+W \rightarrow$ NO Reaction
5. $AlWO_4$(from equ. 3)$+Ba \rightarrow BaO+WO_2+AlO$
6. $Sc_2(WO_4)_3+Ba \rightarrow 2WO_3+WO_2+2ScO+BaO$ As a result, one can see that the amount of oxygen deficient compound, $WO_2$, and fully oxidized material, $WO_3$, formed on the emissive surface of the cathode can be controlled by the amount of $Al_2O_3$ and $Sc_2O_3$ in the top layering. Since the electron emission efficiency of the cathode is directly dependant on the amount of oxygen deficient material and the amount of fully oxidized material in the top layering, the emissions of the cathode can be enhanced by optimizing the amount of $Al_2O_3$ and $Sc_2O_3$ included in the formation of the top layer. The skilled in the art can readily determine the optimum amount of these materials, based on the above equations to optimize the electron emissions of a cathode employing the above configuration. For example, the amount of $Al_2O_3$ and $Sc_2O_3$ can be adjusted so that the ratio of fully oxidized material to oxygen deficient material is one million to one.

It should be emphasized that a cathode employing a mixture of both Aluminum Tungstate and Scandium Tungstate can provide greater emissions than a cathode employing either one alone. The reason is, as shown in the chemical reactions of equations 3, 5 and 6, that a cathode composed of a combination of Aluminum Tungstate and Scandium Tungstate generates both oxygen deficient and fully oxidized material in predetermined amounts, whereas a cathode only employing one or the other of these materials does not provide the combination of equations 3, 5 and 6 and thus not the same amounts of the desired materials.

It should also be emphasized that other combinations of materials, as stated above, can provide the predetermined amounts of Aluminum Tungstate and Scandium Tungstate and thus the enhanced emissions in a similar manner.

Figure 2:
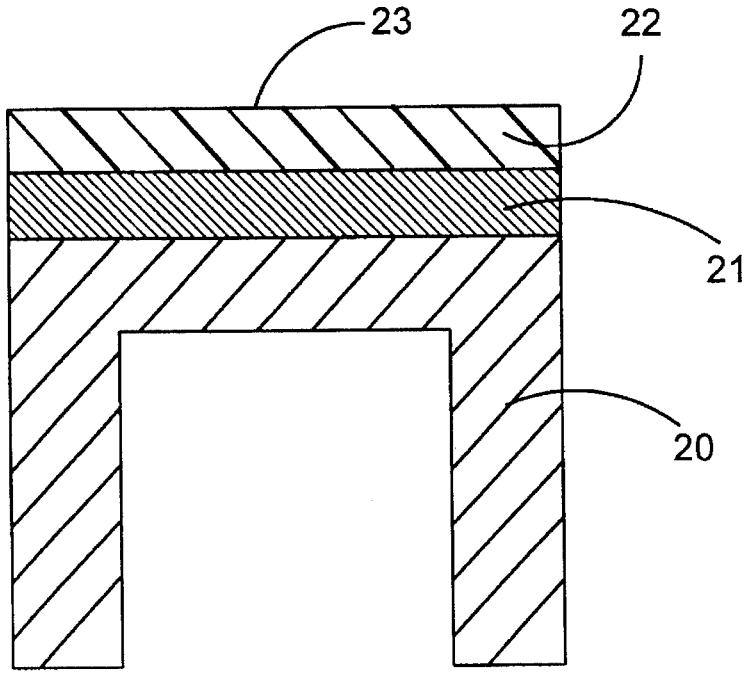
FIG. 2 is a cross-section illustration of another embodiment of the invention wherein a layer-type cathode has a top layer overcoating forming an emissive surface thereon.

In FIG. 2 there is shown another embodiment of the invention, a layer-type thermionic cathode having a base 20, a top-layer or overcoat 22, and a metal layer 21 sandwiched in between top layer 22 and base 20. Depending on the composition of the materials used to form each layer, a thermionic cathode having this structure can provide the enhanced emissions as stated for the thermionic cathode having the impregnated billet structure as described above.

Accordingly, the invention improves to a large extent the limitations of the electron emissions of thermionic cathodes of the prior art.

What is claimed is:

1. An enhanced emission thermionic cathode having a predetermined mixture of Barium and Tungsten, comprising a predetermined mixture of Aluminum Tungstate and Scandium Tungstate that react with the Barium and Tungsten to provide the enhanced emission.

2. An enhanced electron emission thermionic cathode having a predetermined mixture of Barium and Tungsten, comprising an overcoating of emissive material forming an emissive surface on the cathode, said overcoating of emissive material including a predetermined mixture of Aluminum Tungstate and Scandium Tungstate which react when heated with the Barium and Tungsten to provide the enhanced electron emissions.

3. A thermionic cathode as recited in claim 2 wherein the cathode is an impregnant-type cathode.

4. A thermionic cathode as recited in claim 2 wherein the cathode is a layer-type cathode.

5. An enhanced electron emission thermionic cathode, comprising:

a base material having a composition including Barium and Tungsten; and an overcoating of emissive material forming an emissive surface on said base material;

said overcoating of emissive material having a composition formed from a predetermined combination of materials, said composition of said overcoating including a predetermined mixture of Aluminum Tungstate and Scandium Tungstate which react with said base material when heated to provide the enhanced electron emissions.

6. A thermionic cathode as recited in claim 5 wherein said predetermined combination of materials includes $Al_2O_3$ and $Sc_2O_3$.

7. A thermionic cathode as recited in claim 5 wherein said predetermined combination of materials includes $A1ScO_3$.

8. A thermionic cathode as recited in claim 5 wherein said predetermined mixture of Aluminum Tungstate and Scandium Tungstate generate a predetermined amount of oxygen deficient material and fully oxidized material when heated, said amount of fully oxidized material being greater than said amount of oxygen deficient material.

9. The cathode of claim 8 wherein said amount of fully oxidized material and said amount of oxygen deficient material have a ratio of one million to one.

* * * * *